US006613990B2

(12) United States Patent
Kawasaki

(10) Patent No.: US 6,613,990 B2
(45) Date of Patent: Sep. 2, 2003

(54) SWITCH

(75) Inventor: Hiroshi Kawasaki, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/254,532

(22) Filed: Sep. 26, 2002

(65) Prior Publication Data

US 2003/0057063 A1 Mar. 27, 2003

(30) Foreign Application Priority Data

Sep. 26, 2001 (JP) ..... P2001-292849

(51) Int. Cl.[7] ..... H01H 25/04
(52) U.S. Cl. ..... 200/6 A; 200/339; 200/329
(58) Field of Search ..... 200/4, 5 R, 5 A, 200/6 A, 17 R, 18, 517, 520, 553, 329, 330, 331, 339, 341, 343, 345

(56) References Cited

U.S. PATENT DOCUMENTS

| | | | | | |
|---|---|---|---|---|---|
| 4,767,895 | A | * | 8/1988 | Parrish | 200/43.04 |
| 5,399,820 | A | * | 3/1995 | Silfvast | 200/314 |
| 5,496,977 | A | * | 3/1996 | Date et al. | 200/6 A |
| 6,359,243 | B1 | * | 3/2002 | Nakade et al. | 200/6 A |
| 6,525,279 | B2 | * | 2/2003 | Sato | 200/6 A |

* cited by examiner

*Primary Examiner*—Michael Friedhofer
(74) *Attorney, Agent, or Firm*—Whitham, Curtis & Christofferson, PC

(57) ABSTRACT

In a switch, a pad bottom is provided on a rubber switch. The pad bottom has a first opening and a second opening. A pad top is operable to move the pad bottom so as to depress the rubber switch. The pad top includes a first leg portion which has a hook and a second leg portion which has a screw hole. The hook is engaged with the pad bottom through the first opening. A screw threads in the screw hole through the second opening to fix the pad bottom to the pad top.

2 Claims, 2 Drawing Sheets

SWITCH

BACKGROUND OF THE INVENTION

This invention generally relates to a switch and, more particularly, to a cross key switch for use in a game controller, in which four rubber switches for outputting signals respectively corresponding to four directions are disposed on a base board, and in which a pad bottom for depressing the rubber switches is put on the rubber switches, and in which a pad top is mounted on the pad bottom.

A related cross key switch of such a kind is described hereinbelow with reference to FIG. 2. In a cross key switch 1, a casing 3 is provided on a base board 2. Further, four contact portions (not shown) for outputting signals respectively corresponding to four directions are provided on the base board 2 in the casing 3. Rubber switches 4 are disposed on the contact portions, respectively. A disk-like pad bottom 5 for depressing the rubber switches 4 is put on the rubber switches 4.

Further, a central axis portion 6 is provided in the central portion of the pad bottom 5 in such a way as to upwardly or downwardly pass therethrough. A recessed portion 7 is bored in the top part of the central axis portion 6. A projecting portion 9 provided on the bottom face of a pad top 8 in such a manner as to hang therefrom is press-fitted into the recessed portion 7. Thus, the pad top 8 is attached to the pad bottom 5. On the other hand, the bottom face portion of the central axis portion 6 is formed as a spherical portion 10. This spherical portion 10 is in contact with the top face of the base board 2 and serves as a swinging fulcrum for the pad bottom 5. Incidentally, the top portion of the pad top 8 is exposed above the casing 3 and protrudes therefrom and enabled to be externally operated.

Thus, when a part of the top face of the pad top 8, which part is located in one radial direction from the center of the top face, is depressed, the spherical portion 10 including the bottom face of the pad bottom 5 serves as a swinging fulcrum. The rubber switch 4 disposed at a place just under the part located in the depressing direction, in which this part of the top face of the pad top 8 is depressed, is pushed down, so that the rubber switch 4 placed under the depressed part corresponding to the depressing direction is electrically conducted to the contact portion formed on the base board 2. Thus, a signal output is generated.

Incidentally, even when a part in a direction other than the four directions from the center of the top face of the pad top 8 is depressed, one of the rubber switches 4, 4, which is contiguous to a place located just under the depressed part placed in the depressing direction, is pushed down, so that an output corresponding to the depressing direction is obtained.

However, the cross key switch 1 is configured so that the projecting portion 9 of the pad top 8 is mounted therein by being press-fitted into the recessed portion 7 of the pad bottom 5. Thus, it is necessary for facilitating the press-fitting of the projecting portion 9 into the recessed portion 7 that the pad top 8 and the pad bottom 5 are made of different materials, respectively, for example, the pad top 8 is made of a hard material, while the pad bottom 5 is made of a relatively soft material. Thus, the related cross key switch has encountered the problems that variation in the quality among the components thereof occurs, and that the functional characteristics thereof are unstable.

SUMMARY OF THE INVENTION

It is therefore an object of the present invention to provide a switch, in which variation in the quality among the components thereof is eliminate and the functional characteristics thereof is stabilized.

In order to achieve the above object, according to the present invention, there is provided the switch comprising:

- a rubber switch;
- a pad bottom, provided on the rubber switch, the pad bottom having a first opening and a second opening;
- a pad top, operable to move the pad bottom so as to depress the rubber switch, the pad top including a first leg portion which has a hook and a second leg portion which has a screw hole, the hook engaged with the pad bottom through the first opening; and
- a screw, threading in the screw hole through the second opening to fix the pad bottom to the pad top.

Preferably, the pad top and the pad bottom are comprised of a same material.

In the above constructions, the pad top and the pad bottom can be made of the same material. Further, variation in the quality of components can be eliminated. Moreover, the functional characteristics can be stabilized. Furthermore, the enjoyment of the hook-engagement of the leg portions enhances the assemblability of the switch. Consequently, the invention has quite considerably excellent effects.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1A:
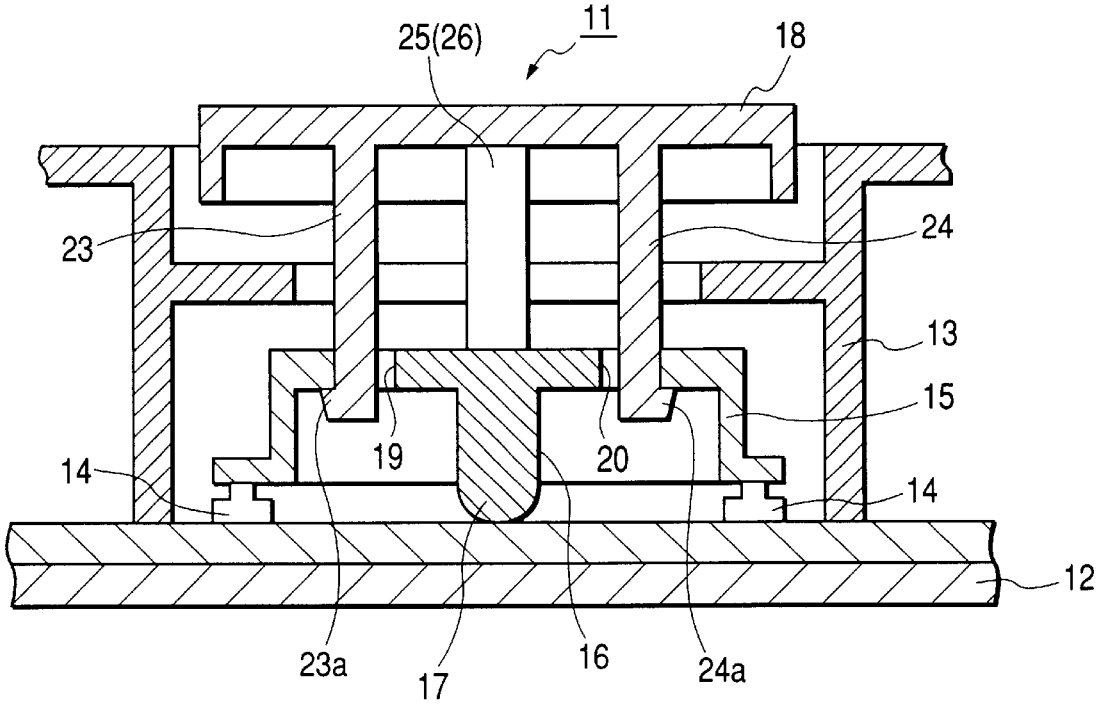
FIG. 1A is a longitudinally sectional front view of a cross key switch, which illustrates an embodiment of the invention.
Figure 1B:
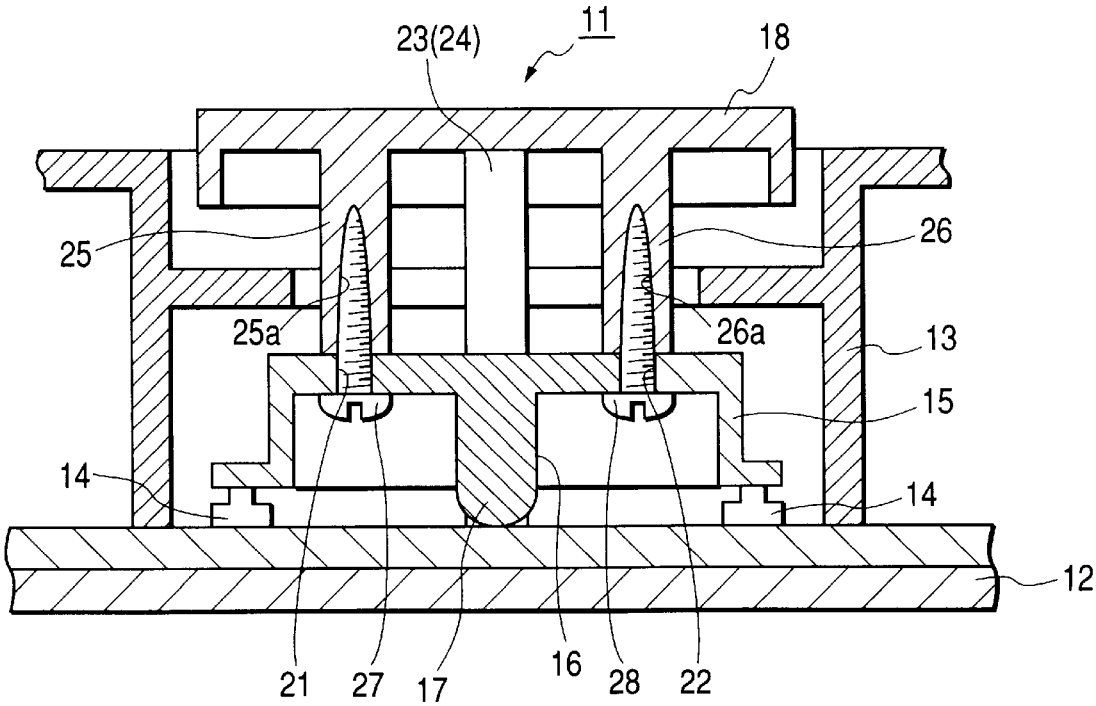
FIG. 1B is a longitudinally sectional side view of the cross key switch, which illustrates the embodiment of the invention.
Figure 2:
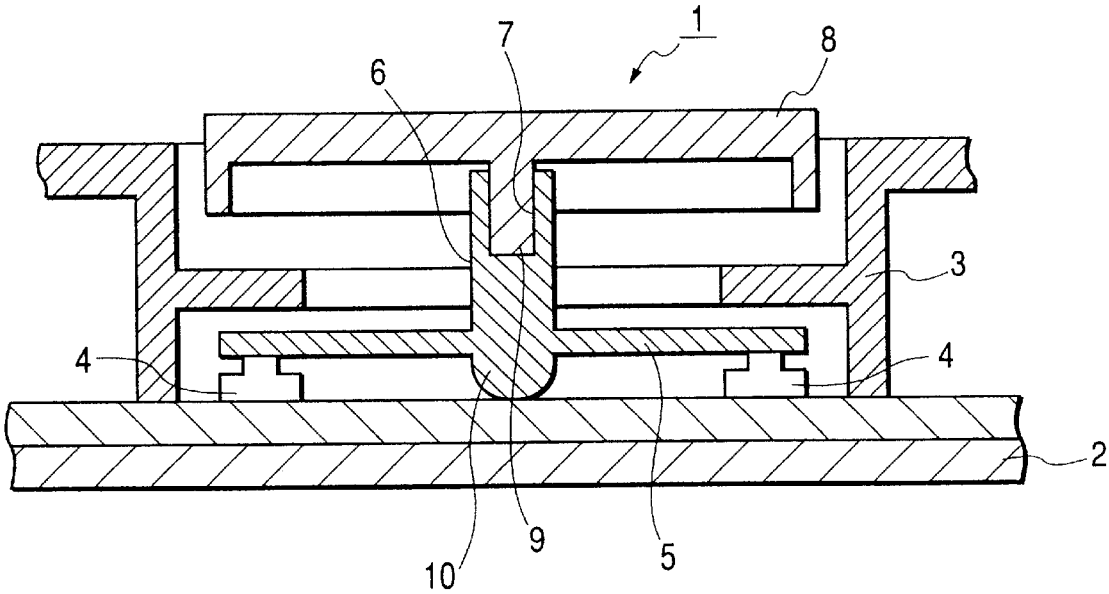
PRIOR ART FIG. 2
FIG. 2 is a longitudinally sectional front view of a related cross key switch, which illustrates the related art.

An embodiment of the invention is described in detail with reference to FIG. 1. FIG. 1A is a longitudinally sectional front view of a cross key switch 11. FIG. 1B is a longitudinal side view of the cross key switch 11.

In this cross key switch 11, a casing 13 is provided on a base board 12. Further, four contact portions (not shown) for outputting signals respectively corresponding to four directions are provided on the base board 12 in the casing 13. Rubber switches 4 are disposed on the contact portions, respectively. A reversed-disk-like pad bottom 15 for depressing the rubber switches 4 is put on the rubber switches 4.

Further, a central axis portion 16 is provided in the central portion of the pad bottom 15 in such a way as to downwardly hang therefrom. The bottom portion 17 of the central axis portion 16 is formed as the spherical portion 17. This spherical portion 17 is constructed in such a way as to serve as a swinging fulcrum for the pad bottom 15. Openings 19 and 20 for engaging the pad top 18 to the pad bottom 15 and openings 21 and 22 for fixing the pad top 18 to the pad bottom 15 are formed on an upper portion of the pad bottom 15.

Furthermore, the top portion of the pad top 18 is exposed above the casing 13 and protrudes therefrom and enabled to be externally operated. Four leg portions 23, 24, 25, and 26 are provided thereunder in such a manner as to hang therefrom. A set of the leg portions 23 and 24 facing each other is formed so as to be relatively long, as compared with the other leg portions 25 and 26. Moreover, hooks 23*a* and 24*a* are formed on the bottom portions of the leg portions 23 and 24, respectively. Female screws 25*a* and 26*a* are threaded in the bottom portions of the other set of the leg portions 25 and 26, respectively.

Therefore, the hooks 23*a* and 24*a* respectively formed on the leg portions 23 and 24 of the pad top 18 are passed through and engaged with the openings 19 and 20 of the pad bottom 15. Moreover, the female screws 25*a* and 26*a* of the leg portions 25 and 26 are positioned in the openings 21 and 22. Screws 27 and 28 passed through the openings 21 and 22 are screwed into the female screws 25*a* and 26*a*, respectively such that the pad top 18 is fixed to the pad bottom 15.

Thus, when a part of the top face of the pad top 18, which is located in a direction from the center thereof, is depressed, the spherical portion 17 provided on the bottom face of the pad bottom 15 serves as a swinging fulcrum. Then, the rubber switch 14 provided just under the depressed part located in a depressing direction, in which the depressed part is placed, from the center thereof is depressed, so that the rubber switch 14 is electrically connected to the contact portion formed on the base board 12, and that a signal output is generated.

Further, even when a part in a direction other than the four directions from the center of the top face of the pad top 18 is depressed, one of the rubber switches 14, which is contiguous to a place located just under the depressed part placed in the depressing direction, is pushed down, so that an output corresponding to the depressing direction is obtained.

Thus, the cross key switch 11 is constructed so that the hooks 23*a* and 24*a* are provided at ends of the two leg portions 23 and 24 facing each other, which are provided on the bottom face of the pad top 18 in such a way as to hang therefrom, that the hooks 23*a* and 24*a* are engaged with the openings 19 and 21 of the pad bottom 15, and that the two leg portions 25 and 26 are screwed into the pad top 18 by using the screws 27 and 28.

Consequently, the pad top 18 is reliably fixed to the pad bottom 15. According to such a fixing method, the pad top 18 and the pad bottom 15 can be made of the same material. Thus, the variation in the quality among the components of the sensor can be suppressed. Moreover, the functional characteristics thereof are stabilized.

Further, the use of the hooks 23*a* and 24*a* facilitates the assembly of the cross key switch.

Incidentally, various changes and modifications may be made without departing from the spirit of the invention. Further, needless to say, the invention covers the changes and modifications.

What is claimed is:

1. A switch comprising:

a rubber switch;

a pad bottom, provided on the rubber switch, the pad bottom having a first opening and a second opening;

a pad top, operable to move the pad bottom so as to depress the rubber switch, the pad top including a first leg portion which has a hook and a second leg portion which has a screw hole, the hook engaged with the pad bottom through the first opening; and a screw, threading in the screw hole through the second opening to fix the pad bottom to the pad top.

2. The switch as set forth in claim 1, wherein the pad top and the pad bottom are comprised of a same material.

* * * * *